US009561807B2

(12) United States Patent
Vicente Corral et al.

(10) Patent No.: US 9,561,807 B2
(45) Date of Patent: Feb. 7, 2017

(54) ELASTIC COUPLING BETWEEN RAIL VEHICLE WAGONS

(75) Inventors: Maria Teresa Vicente Corral, Madrid (ES); Andres Lopez Bonaque, Madrid (ES); Miguel Angel Moñino, Madrid (ES)

(73) Assignee: PATENTES TALGO, S.L., Las Matas, Madrid (ES)

( * ) Notice: Subject to any disclaimer, the term of this patent is extended or adjusted under 35 U.S.C. 154(b) by 90 days.

(21) Appl. No.: 14/385,221

(22) PCT Filed: Mar. 15, 2012

(86) PCT No.: PCT/ES2012/070169

§ 371 (c)(1),
(2), (4) Date: Sep. 15, 2014

(87) PCT Pub. No.: WO2013/135918

PCT Pub. Date: Sep. 19, 2013

(65) Prior Publication Data

US 2015/0034582 A1 Feb. 5, 2015

(51) Int. Cl.

| | |
|---|---|
| ***B61G 5/00*** | (2006.01) |
| ***B61G 5/02*** | (2006.01) |
| ***B61G 11/00*** | (2006.01) |

(52) U.S. Cl.

CPC . *B61G 5/00* (2013.01); *B61G 5/02* (2013.01); *B61G 11/00* (2013.01)

(58) Field of Classification Search

CPC ..... B61G 1/00; B61G 1/22; B61G 1/28; B61G 1/40; B61G 5/00; B61G 5/02; B61G 5/04; B61G 9/00; B61G 9/02; B61G 9/04; B61G 9/06; B61G 9/08; B61G 9/12

USPC ..... 213/7–11, 22, 40 R, 75 R–79

See application file for complete search history.

(56) References Cited

U.S. PATENT DOCUMENTS 7,708,157 B2 * 5/2010 Kemper ..... B61G 7/08 213/57

FOREIGN PATENT DOCUMENTS

| | | | |
|---|---|---|---|
| CH | 452586 | A | 3/1968 |
| EA | 201001789 | A2 | 6/2011 |
| EP | 1663755 | A1 | 6/2006 |
| EP | 1857342 | A1 | 11/2007 |
| ES | 2203569 | T3 | 4/2004 |
| WO | 2011162671 | A1 | 12/2011 |

* cited by examiner

*Primary Examiner* — R. J. McCarry, Jr.
(74) *Attorney, Agent, or Firm* — Albert Bordas, P.A.

(57) ABSTRACT

The present invention relates to an elastic coupling (1) between rail vehicle wagons, comprising:

an end support (2) or curved head (8) in turn comprising a screwed straight area (5), an intermediate deformation area (6) and an end coupling area (7), the end (8) of the coupling area (7) being curved, an end support (3) or straight head (8') in turn comprising a screwed straight area (5'), an intermediate deformation area (6') and an end coupling area (7'), the end (8') of the coupling area (7') being straight, and an enclosing case (4) covering the end coupling area (7) of the support (2) and the end coupling area (7') of the support (3), such that the supports (2) and (3) are attached to one another by draw connection means and by elastic elements. The walls of the intermediate area 6 of the support 2 are curved inwards, and the walls of the intermediate area 6' of the support 3 are curved outwards.

3 Claims, 1 Drawing Sheet

ELASTIC COUPLING BETWEEN RAIL VEHICLE WAGONS

FIELD OF THE INVENTION

The present invention relates to an elastic coupling that is able to absorb energy by deformation, of the type that are located between rail vehicle wagons and transmit longitudinal loads.

BACKGROUND OF THE INVENTION

The function of elastic couplings used between wagons in trains employing Talgo technology is to transmit longitudinal loads. These couplings are formed by two supports made of cast steel, one screwed to each end of the adjacent wagons.

The end or head of one of the supports of the coupling is curved, and the end or head the other support is flat, which allows certain rotation between wagons. The heads of the supports are attached to one another by an intermediate pin (also referred to as draw bolt) as well as by elastic parts to assure the draw and correct operation under normal use conditions.

To assure compliance with structural passive safety requirements in the event of various collision scenarios, it is necessary to include a certain ability to absorb energy between two adjacent wagons. This absorption must assure that no structural deformation of vehicles occurs such that it may compromise the interior compartment intended for passengers.

Due to the location of the elastic coupling as a rigid element between two wagons, in many Talgo trains today this absorption of energy is done as a result of the failure of the connection elements between support and structure. There is included behind the support an absorption element for absorption by deformation, which absorbs energy while the support is gradually introduced into the vehicle structure.

This configuration has the drawback of requiring free space inside the wagon and an additional element for absorbing energy.

BRIEF DESCRIPTION OF THE INVENTION

Therefore, the object of the present invention is to provide an elastic coupling between rail vehicle wagons that overcomes the aforementioned drawbacks.

The invention provides an elastic coupling between rail vehicle wagons, comprising:

- an end support or curved head in turn comprising a screwed straight area, an intermediate deformation area and an end coupling area, the end of the coupling area being curved,
- an end support or straight head in turn comprising a screwed straight area, an intermediate deformation area and an end coupling area, the end of the coupling area being straight, and
- an enclosing case covering the end coupling area of the end support or curved head and the end coupling area of the end support or straight head, such that the supports are attached to one another by draw connection means and by elastic elements, in which the walls of the intermediate deformation area of the end support or curved head are curved inwards, and the walls of the intermediate deformation area of the end support or straight head are curved outwards.

By means of this configuration, deformation areas and stress cracks in the supports of the coupling are controlled.

Other features and advantages of the present invention will be inferred from the following detailed description of an illustrative embodiment of the object of the present invention in relation to the attached drawings.

DETAILED DESCRIPTION OF THE INVENTION

Figure 1:
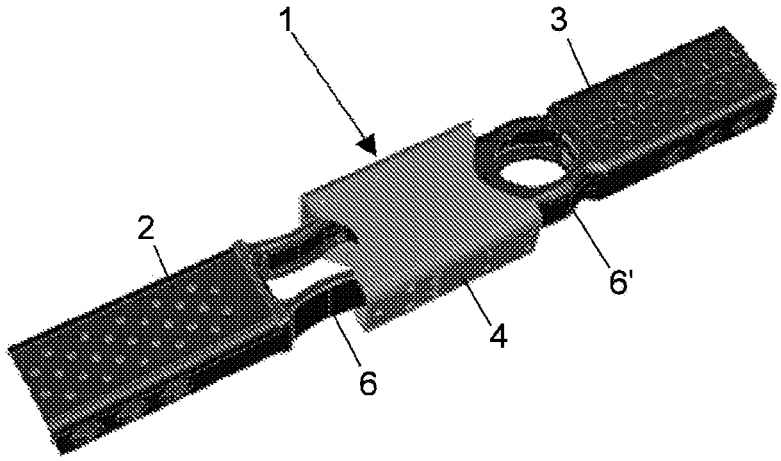
FIG. 1 shows a perspective view of a complete elastic coupling of the invention.
Figure 2:
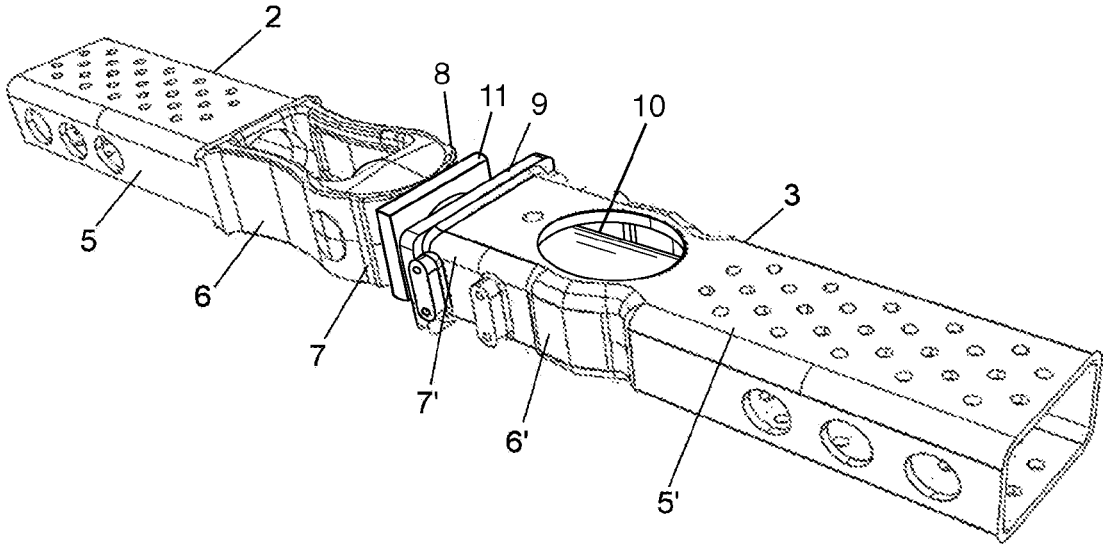
FIG. 2 shows a perspective view of the supports of the elastic coupling of the invention.

FIG. 1 shows a perspective view of the elastic coupling 1, with its three main portions: an end support 2 with curved head 8, an end support 3 with straight head 9 and an enclosing case 4 of the coupling area. FIG. 2 shows the end support 2 having a curved head 8 and the end support 3 having a straight head 9 aligned with one another and without the enclosing case 4.

Each of the end supports 2, 3 is screwed to the end of the structure of the corresponding adjacent wagon. The heads 8, 9 of the end supports 2, 3 are attached to one another by means of a draw bolt 10 or pin as a draw connection element and by elastic element 11.

The end support 2 having a curved head 8 has three distinct areas: a straight area 5 (which enters the wagon structure), an intermediate deformation area 6 and an end coupling area 7 (covered by the enclosing case 4 in FIG. 1).

The end support 3 having a straight head 9 likewise has three distinct areas: a straight area 5' (which enters the wagon structure), an intermediate deformation area 6' and an end coupling area 7' (covered by the enclosing case 4 in FIG. 1).

The end supports 2, 3 of the elastic coupling 1 deform in their respective intermediate deformation areas 6, 6', absorbing energy.

These intermediate deformation areas 6, 6' are designed with an optimized geometry that assures the formation of stress cracks in the designed areas in order to know about and control their limit of growth, thereby preventing unwanted cracks.

Specifically, the walls of the intermediate deformation areas 6, 6' take a rounded, not straight, shape as is common in the prior art. The walls corresponding to the intermediate deformation area 6 of the end support 2 having a curved head 8 are curved inwards, and the walls corresponding to the intermediate deformation area 6' of the end support 3 having a straight head 9 are curved outwards, as can be seen in both FIG. 1 and FIG. 2.

These are the free areas for deformation of the end supports 2, 3, which are precisely those areas located between the walls of the wagons (outside their structure) and the enclosing case 4 covering the draw connection element draw bolt 10 or pin and the elastic element 11 of the attachment.

The intermediate deformation areas 6, 6' are hollow because the draw bolt 10 or pin connecting both wagons has to be introduced into the inner space.

Furthermore, the end supports 2 and 3 can be made of cast steel with a special treatment to assure maximum ductility.

The end support 2 having a curved head 8 deforms under a force at least 20% greater than the end support 3 having a straight head 9 to assure operation in the event of impact since both end supports 2 and 3 are located in series.

Although embodiments of the invention have been described and depicted, modifications comprised within the scope of the invention can obviously be introduced in said embodiments, and said scope should not be considered as being limited by said embodiments, rather it is limited only by the content of the following claims.

The invention claimed is:

1. An elastic coupling (1) between rail vehicle wagons, comprising:

A) a first end support (2) as a first coupler assembly comprising a first straight wall (5), extending from said first straight wall (5) is a first intermediate deformation (6) having first lateral walls that are inwardly curved, said first intermediate deformation (6) extends to a first end coupling (7) comprising a curved head (8);

B) a second end support (3) as a second coupler assembly comprising a second straight wall (5'), extending from said second straight wall (5') is a second intermediate deformation (6') having second lateral walls that are outwardly curved, said second intermediate deformation (6') extends to a second end coupling (7') comprising a straight head (9);

C) a bolt (10) that connects said first end support (2) to said second end support (3), said second coupler assembly is on a separate and adjacent rail vehicle wagon from said first coupler assembly;

D) an elastic element (11) positioned between said curved head (8) and said straight head (9), said elastic element (11) is mounted onto said bolt (10); and E) an enclosing case (4) that covers said curved head (8) and said straight head (9).

2. The elastic coupling (1) between rail vehicle wagons set forth in claim 1, further characterized in that said first intermediate deformation (6) and said second intermediate deformation (6') are internally hollow.

3. The elastic coupling (1) between rail vehicle wagons set forth in claim 2, further characterized in that said first end support (2) and said second end support (3) are in series.

* * * * *